US012350601B2

(12) United States Patent
Chen et al.

(10) Patent No.: US 12,350,601 B2
(45) Date of Patent: Jul. 8, 2025

(54) UNDERWATER ROBOTIC DEVICE

(71) Applicant: Pioneer Material Precision Tech Co., Ltd., New Taipei (TW)

(72) Inventors: Chih-Sheng Chen, New Taipei (TW); Ching-Hung Liu, New Taipei (TW)

(73) Assignee: PIONEER MATERIAL PRECISION TECH CO., LTD., New Taipei (TW)

( * ) Notice: Subject to any disclaimer, the term of this patent is extended or adjusted under 35 U.S.C. 154(b) by 200 days.

(21) Appl. No.: 18/468,529

(22) Filed: Sep. 15, 2023

(65) Prior Publication Data

US 2024/0408505 A1 Dec. 12, 2024

(30) Foreign Application Priority Data

Jun. 9, 2023 (TW) ..... 112121563

(51) Int. Cl.
*A63H 23/04* (2006.01)
*A63H 11/00* (2006.01)
(Continued)

(52) U.S. Cl.
CPC ..... *A63H 23/04* (2013.01); *A63H 23/14* (2013.01); *A63H 29/22* (2013.01);
(Continued)

(58) Field of Classification Search
CPC ... B63G 8/14; B63G 8/20; B63G 8/24; A63H 23/04; A63H 23/06; A63H 23/14; B63H 1/36
See application file for complete search history.

(56) References Cited

U.S. PATENT DOCUMENTS 1,427,669 A * 8/1922 Wilson et al. ..... A63H 23/04 446/162
3,362,367 A * 1/1968 Rosfelder ..... B63G 8/26 114/330
2013/0017754 A1* 1/2013 Lu ..... A63H 33/26 446/158

FOREIGN PATENT DOCUMENTS

CN 105905265 A * 8/2016 ..... B63G 8/26
CN 106005333 A * 10/2016 ..... B63C 11/52
(Continued)

OTHER PUBLICATIONS

Search Report appended to an Office Action, which was issued to Taiwanese counterpart application No. 112121563 by the TIPO on Dec. 4, 2023, with an English translation thereof (2 pages).

*Primary Examiner* — Alexander K Garlen
(74) *Attorney, Agent, or Firm* — HSML P.C.

(57) ABSTRACT

An underwater robotic device includes a housing unit, a control unit and a propelling unit. The housing unit includes a base seat and an upper cover in liquid-tight engagement with the base seat. The control unit is disposed within the housing unit and includes a circuit module and a center-of-gravity transferring module which is electronically connected with the circuit module. The center-of-gravity transferring module has a movable weight member and a transfer driving mechanism which drives movement of the weight member so as to vary a position of a center of gravity of the underwater robotic device and to control downward and upward moving directions of the underwater robotic device in the water. The propelling unit is connected with the housing unit and is electronically connected with the control unit to produce a propelling force to move the underwater robotic device forward in the water.

10 Claims, 10 Drawing Sheets

(51) Int. Cl.

| | |
|---|---|
| ***A63H 23/14*** | (2006.01) |
| ***A63H 29/22*** | (2006.01) |
| ***B63G 8/20*** | (2006.01) |
| ***B63G 8/24*** | (2006.01) |
| ***B63H 1/32*** | (2006.01) |
| ***B63H 1/36*** | (2006.01) |

(52) U.S. Cl.
CPC ..... *A63H 2011/16* (2013.01); *B63G 8/20* (2013.01); *B63G 8/24* (2013.01); *B63H 1/32* (2013.01); *B63H 1/36* (2013.01)

(56) References Cited

FOREIGN PATENT DOCUMENTS

| | | | | | |
|---|---|---|---|---|---|
| CN | 107161304 | A | * | 9/2017 | ..... B63G 8/001 |
| CN | 109204744 | A | * | 1/2019 | |
| CN | 110282100 | A | * | 9/2019 | ..... B63C 11/34 |
| CN | 111846165 | A | * | 10/2020 | ..... B63C 11/52 |
| CN | 113229233 | A | | 8/2021 | |
| CN | 113682452 | A | * | 11/2021 | |
| CN | 214962093 | U | | 12/2021 | |
| CN | 114604395 | A | * | 6/2022 | |
| CN | 114771785 | A | * | 7/2022 | ..... B63C 11/52 |
| CN | 115107960 | A | * | 9/2022 | ..... B63C 11/52 |
| CN | 116252935 | A | * | 6/2023 | |

* cited by examiner

UNDERWATER ROBOTIC DEVICE

CROSS-REFERENCE TO RELATED APPLICATION

This application claims priority to Taiwanese Patent Application No. 112121563, filed on Jun. 9, 2023, and incorporated by reference herein in its entirety.

FIELD

The disclosure relates to an underwater robotic device, and more particularly to an underwater robotic device with a center-of-gravity transferring module to vary a center of gravity thereof in the water.

BACKGROUND

Underwater robotic devices, such as turtle-like robotic devices, are mechanical devices which emulate the shape of a turtle and its swimming motion in the water. Hence, a conventional turtle-like robotic device has a pair of front limbs and a pair of rear limbs which are movable and can be controlled to ascend or descend in the water.

In order to move the front limbs and hind limbs similar to real turtles, the conventional drive mechanisms for driving the front limbs and hind limbs include many components such as motors, gears, pulleys, belts and linkages, etc. Hence, the entire structure of the underwater robotic device is relatively complicated and is bulky. Additionally, waterproof motors are required, which increases the manufacturing cost of the underwater robotic device.

It is desirable to improve an underwater robotic device by simplifying construction and reducing manufacturing costs, and allowing easier control of ascending and descending thereof in the water in a simple.

SUMMARY

Therefore, an object of the disclosure is to provide an underwater robotic device that has a simple construction and that can alleviate at least one of the drawbacks of the prior art.

According to the disclosure, the underwater robotic device includes a housing unit, a control unit and a propelling unit. The housing unit includes a base seat and an upper cover in liquid-tight engagement with the base seat. The control unit is disposed within the housing unit, and includes a circuit module and a center-of-gravity transferring module which is electronically connected with the circuit module. The center-of-gravity transferring module has a weight member which is movable relative to the base seat in a front-rear direction, and a transfer driving mechanism which is coupled with the weight member to drive movement of the weight member in the front-rear direction so as to vary a position of a center of gravity of the underwater robotic device and to control downward and upward moving directions of the underwater robotic device in the water. The propelling unit is connected with the housing unit and is electronically connected with the control unit to produce a propelling force to move the underwater robotic device forward in the water.

BRIEF DESCRIPTION OF THE DRAWINGS

Other features and advantages of the disclosure will become apparent in the following detailed description of the embodiments with reference to the accompanying drawings. It is noted that various features may not be drawn to scale.

DETAILED DESCRIPTION

Figure 1:
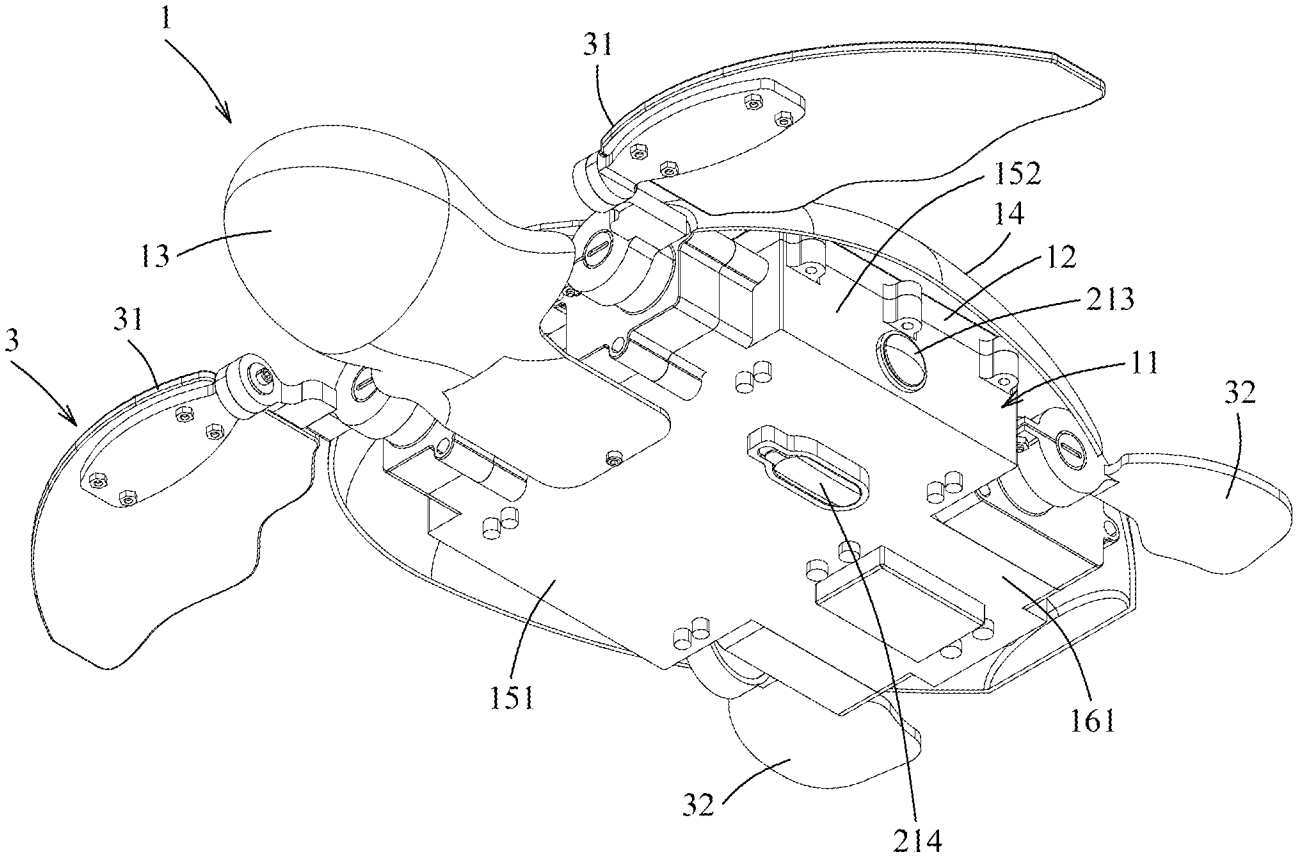
FIG. 1 is a perspective view illustrating an embodiment of an underwater robotic device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
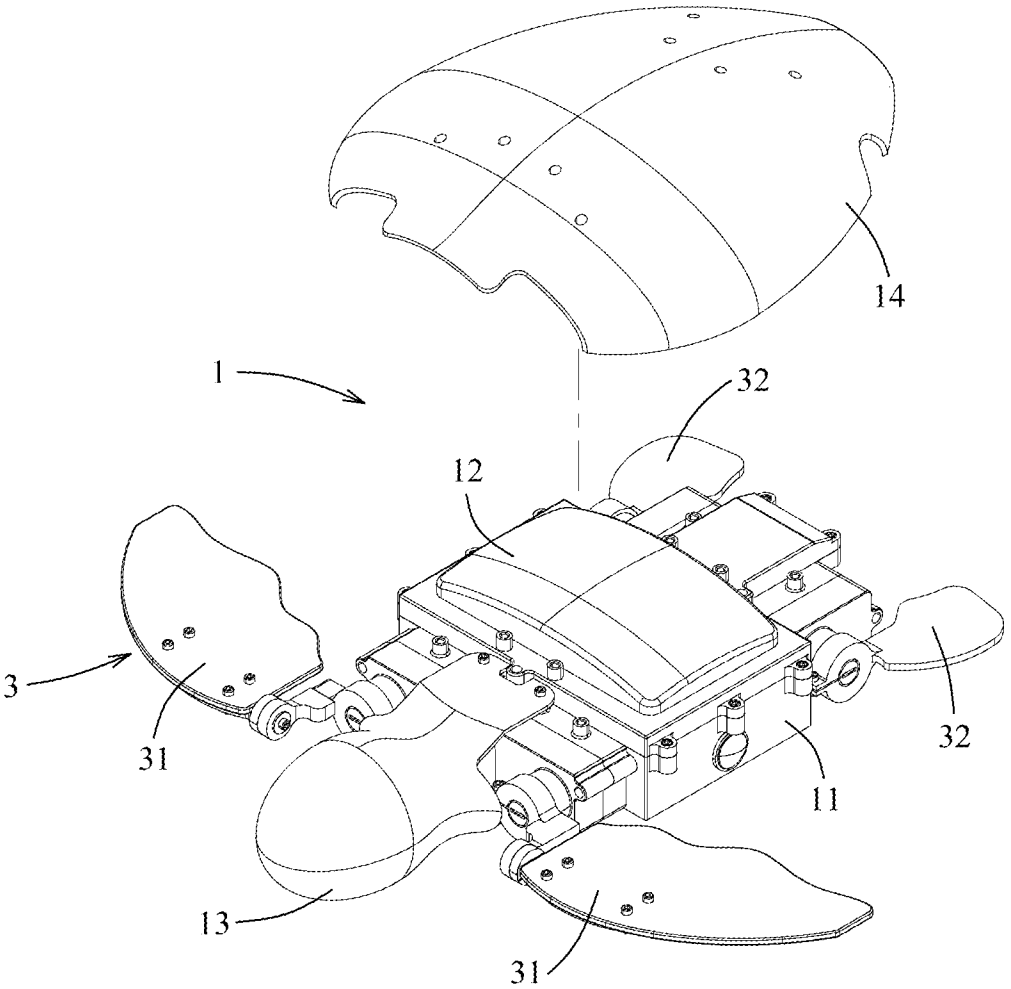
FIG. 2 is an exploded perspective view of the embodiment.
Figure 3:
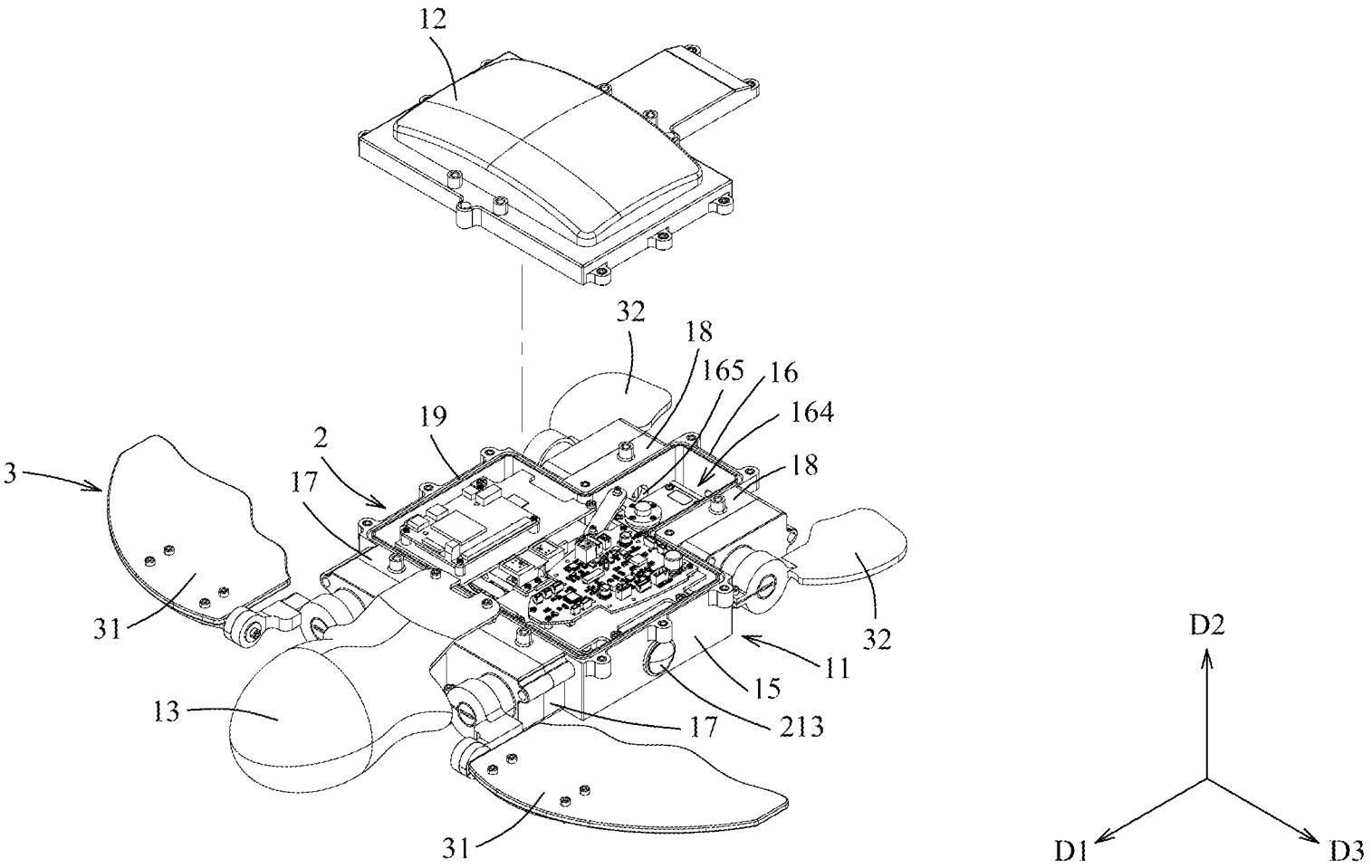
FIG. 3 is an exploded perspective view of the embodiment, a portion thereof being removed for the sake of clarity.

Referring to FIGS. 1 to 3, an embodiment of an underwater robotic device according to the disclosure includes a housing unit 1, a control unit 2 which is disposed within the housing unit 1, and a propelling unit 3 which is connected with the housing unit 1 and electronically connected with the control unit 2. In this embodiment, the underwater robotic device is a turtle-like robotic device.

The housing unit 1 includes a base seat 11, an upper cover 12 in liquid-tight engagement with the base seat 11, a turtle head member 13 which is connected with a front end of the base seat 11, and a dorsal shell member 14 which is connected to the upper cover 12 to conceal the upper cover 12. The turtle head member 13 and the dorsal shell member 14 are disposed to imitate the outward appearance of a turtle.

Figure 4:
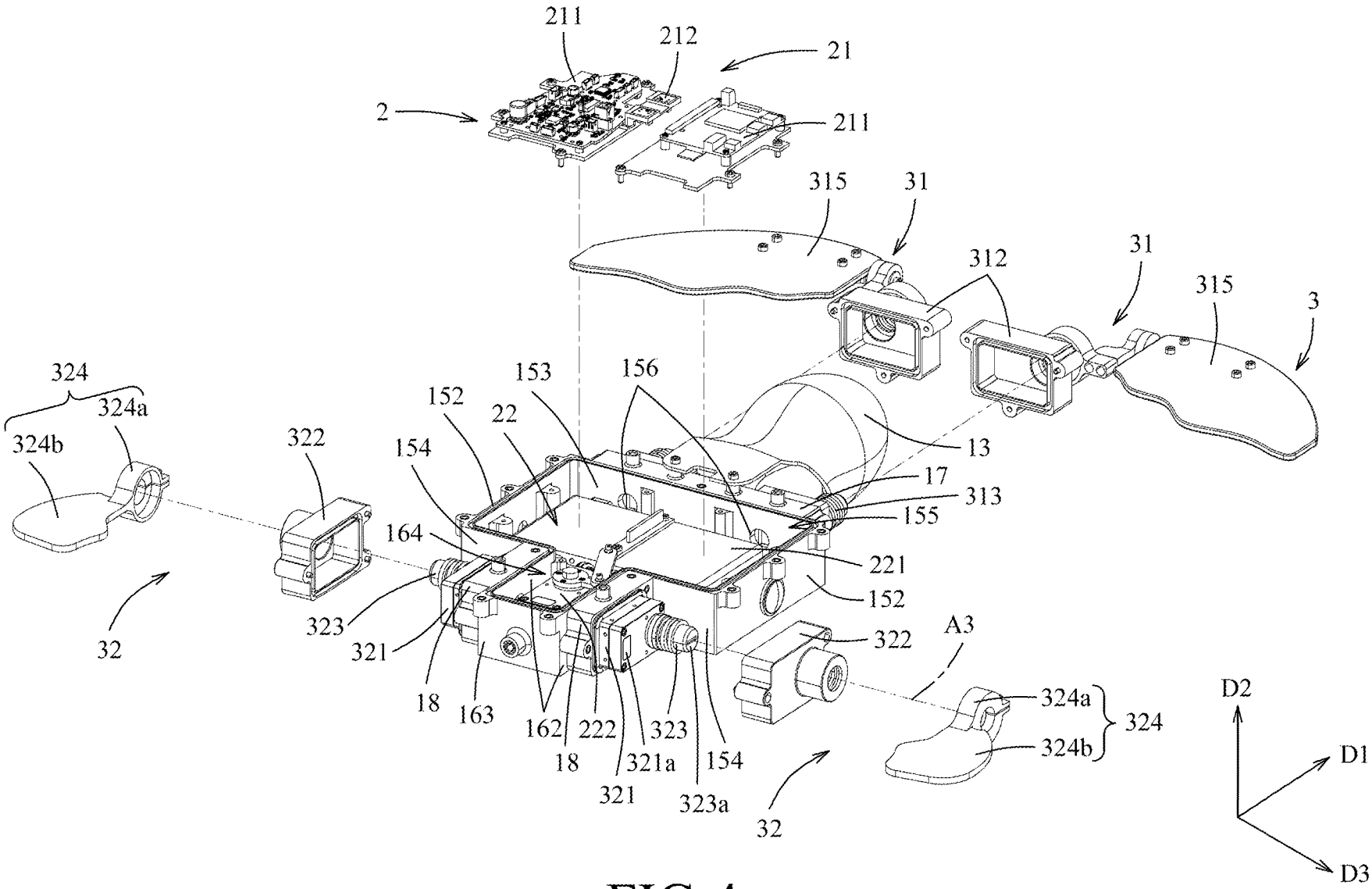
FIG. 4 is an exploded perspective view of the embodiment, a portion thereof being removed for the sake of clarity.
Figure 7:
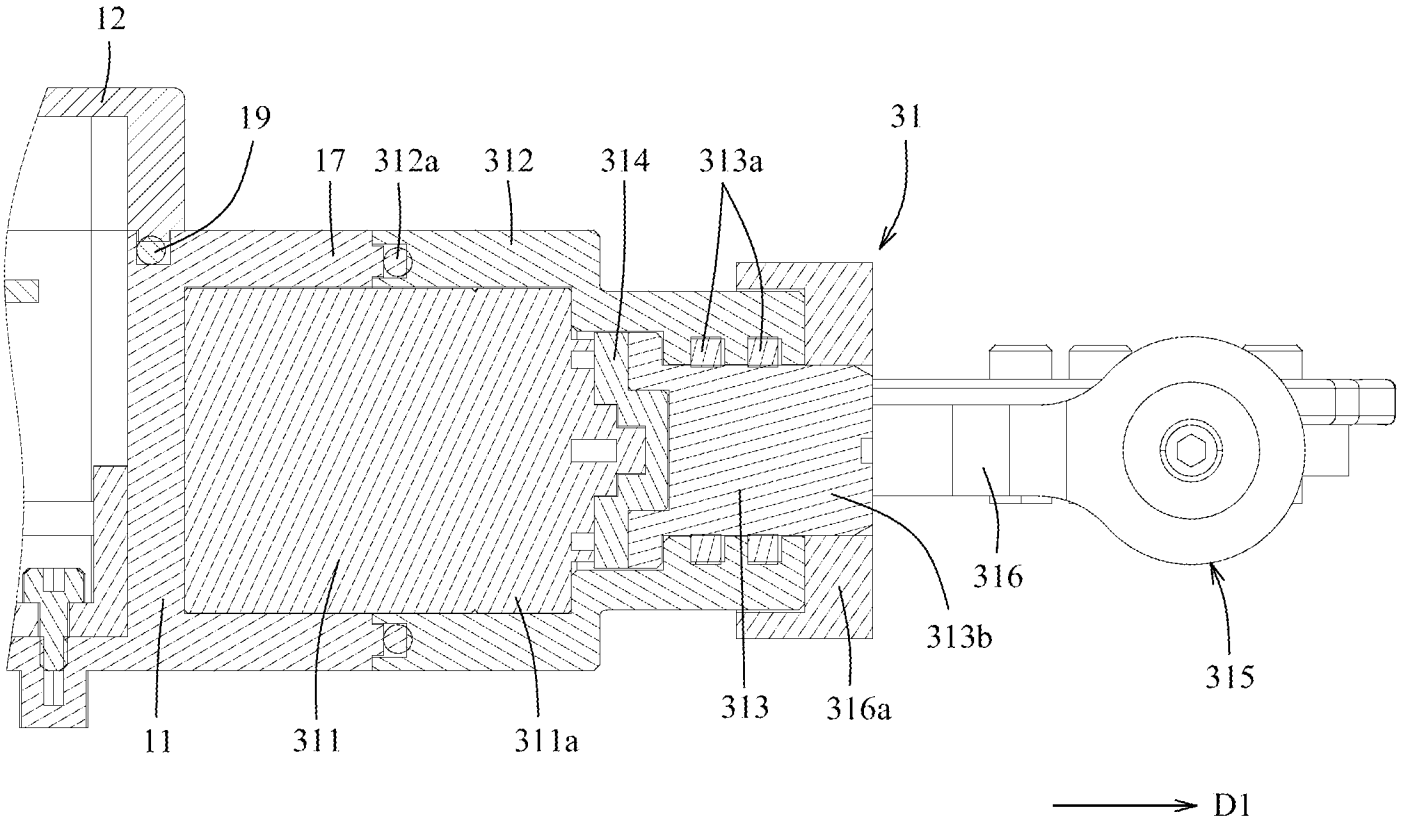
FIG. 7 is a sectional view taken along line VII-VII of FIG. 6.

With reference to FIGS. 1, 3 and 4, the base seat 11 has a front housing 15, a rear housing 16 which is connected with a rear end of the front housing 15, two front mounting cassettes 17 which are connected with and extending from the front housing 15 in a front-rear direction (D1), and two rear mounting cassettes 18 which are connected with and extend from the rear housing 16 in a left-right direction (D3). The front housing 15 has a rectangular front bottom wall 151, two front lateral walls 152 which extend upwardly and respectively from left and right sides of the front bottom wall 151, a leading wall 153 which extends upwardly from a front side of the front bottom wall 151 and which interconnects the front lateral walls 152, and two middle walls 154 which extend upwardly from a rear side of the front bottom wall 151, which are respectively connected with the front lateral walls 152 and which are spaced apart from each other in the left-right direction (D3). The front bottom wall 151, the front lateral walls 152, the leading wall 153 and the middle walls 154 cooperatively border a front compartment 155 thereamong. The rear housing 16 has a rectangular rear bottom wall 161 which extends rearwardly from the rear side of the front bottom wall 151 and between the middle walls 154, two rear lateral walls 162 which extend upwardly and respectively from left and right sides of the rear bottom wall 161 and which are respectively connected with the middle walls 154, and a trailing wall 163 which extends upwardly from a rear side of the rear bottom wall 161 and which interconnects the rear lateral walls 162. The rear bottom wall 161, the rear lateral walls 162 and the trailing wall 163 cooperatively border a rear compartment 164 thereamong. The rear compartment 164 is in communication with the front compartment 155. Specifically, the front mounting cassettes 17 are integrally formed with the leading wall 153 and are spaced apart from each other in the left-right direction (D3). The front housing 15 further has two front wire passages 156 each of which extends through the leading wall 153 to intercommunicate the front compartment 155 and a respective one of the front mounting cassettes 17. The rear mounting cassettes 18 are integrally and respectively formed with the rear lateral walls 162. The rear housing 16 further has two rear wire passages 165 which respectively extend through the rear lateral walls 162 to intercommunicate the rear compartment 164 and a respective one of the rear mounting cassettes 18. In this embodiment, with reference to FIG. 7, the base seat 11 has an elastomeric seal ring 19 which surrounds an upper edge thereof. The upper cover 12 has a peripheral flange matingly engaged with the upper edge of the base seat 11 and is securely mounted on the base seat 11 by means of screw fasteners. With the elastomeric seal ring 19, the upper cover 12 is in liquid-tight engagement with the base seat 11 to prevent liquid entrance through the juncture between the upper cover 12 and the base seat 11.

Figure 5:
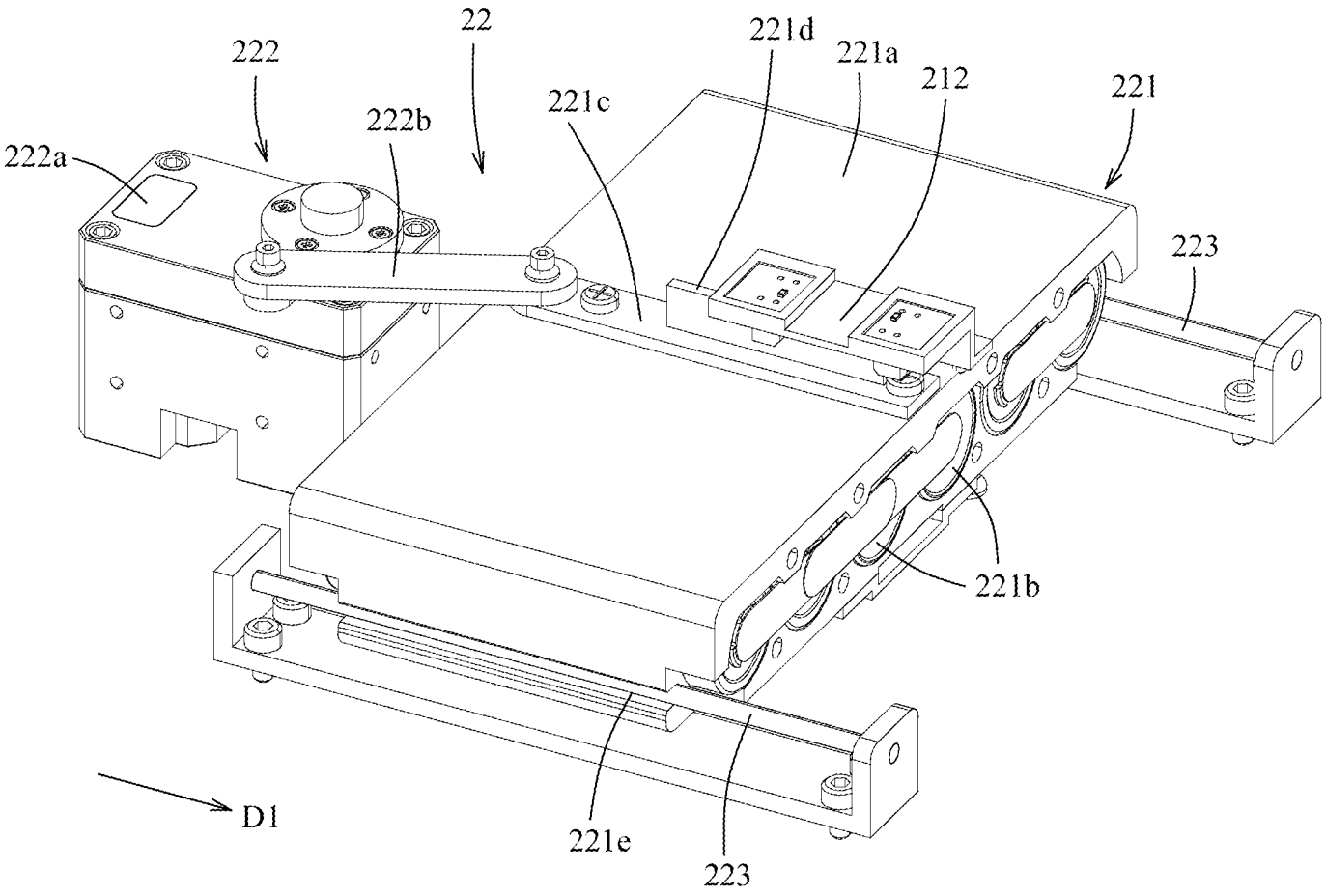
FIG. 5 is a perspective view illustrating a center-of-gravity transferring module of the embodiment.

With reference to FIGS. 3 to 5, the control unit 2 is disposed within the base seat 11, and includes a circuit module 21 and a center-of-gravity transferring module 22 which is electronically connected with the circuit module 21. In this embodiment, the circuit module 21 includes two circuit boards 211 which are electronically connected with each other, a limit switch assembly 212 which is disposed on one of the circuit boards 211, a power switch 213 which is mounted on one of the front lateral walls 152 and electronically connected with the circuit boards 211, and a charging port 214 (see FIG. 1) which is disposed on the front bottom wall 151 and electronically connected with the circuit boards 211. The center-of-gravity transferring module 22 has a weight member 221 which is received in the front compartment 155 and movable relative to the base seat 11 in the front-rear direction (D1) and which has a predetermined weight, a transfer driving mechanism 222 which is coupled with the weight member 221 to drive movement of the weight member 221 in the front-rear direction (D1), and two rail members 223 which are mounted on the front housing 15 to guide the movement of the weight member 221 in the front-rear direction (D1). In this embodiment, the weight member 221 is disposed in the front compartment 155, and is in the form of a battery module which supplies electricity. The weight member 221 has a battery holder case (221*a*), a plurality of batteries (221*b*) which are received in the battery holder case (221*a*), a connecting portion (221*c*) which is disposed on a top surface of the battery holder case (221*a*) and which extends in the front-rear direction (D1), and an inductive sensing portion (221*d*) which is disposed on and extends upwardly from the connecting portion (221*c*) to contact with the limit switch assembly 212. The battery holder case (221*a*) has two sliding slots (221*e*) which are formed at left and right side surfaces thereof and which are respectively and slidably engaged with the rail members 223 to permit the battery holder case (221*a*) to steadily slide along the rail members 223 in the front-rear direction (D1).

The transfer driving mechanism 222 has a primary motor (222*a*) which is disposed in the rear compartment 164 and electronically connected with the circuit boards 211, and a crank linkage assembly (222*b*) which interconnects the primary motor (222*a*) and the weight member 221. The crank linkage assembly (222*b*) is connected with a rear end of the connecting portion (221*c*), and is driven by the primary motor (222*a*) to move the weight member 221 in the front-rear direction (D1). The primary motor (222*a*) is controlled by the circuit module 21 in which the position of the weight member 221 is detected by the limit switch assembly 212, and the primary motor (222*a*) is controlled to determine the movement stroke of the weight member 221. Specifically, the forward and backward movements of the weight member 221 are respectively actuated by clockwise and counterclockwise rotations of the primary motor (222*a*), and the moving speed of the weight member 221 is controlled by the rotational speed of the primary motor (222*a*). Also, the weight member 221 can be kept at a predetermined position during the movement stroke. With the transfer driving mechanism 222 controlled and driving the movement of the weight member 221 to vary a position of a center of gravity of the underwater robotic device, the underwater robotic device can be controlled to move in either a downward or an upward moving direction in the water. For example, when the weight member 221 is controlled to move forward, the center of gravity of the underwater robotic device is transferred to a forward side thereof toward the turtle head member 13 so as to urge the turtle head member 13 downward to permit the underwater robotic device to descend in the water. Similarly, when the weight member 221 is controlled to move rearward, the center of gravity of the underwater robotic device is transferred to a rearward side thereof so as to urge the turtle head member 13 upward to permit the underwater robotic device to ascend in the water.

The center-of-gravity transferring module 22 has a simple construction, and has the transfer driving mechanism 222 drive the movement of the weight member 221 in the front-rear direction (D1) to vary the center of gravity of the underwater robotic device so as to control ascending and descending of the underwater robotic device in the water. Moreover, the circuit module 21 and the center-of-gravity transferring module 22 are disposed within the base seat 11, and the base seat 11 is in liquid-tight engagement with the upper cover 12 to form a liquid-tight space therebetween, which simplifies the structure of the device. Further, in this embodiment, the weight member 221 is a battery module. That is, with the batteries (221*b*) as a weight for the device and a power supply, the center-of-gravity of the underwater robotic device can be easily adjusted and the batteries (221*b*) can supply electricity, which conserves enough space for accommodating an additional weight piece. It is noted that the weight member 221 in other embodiments is not limited to be the battery module.

With reference to FIG. 3, the propelling unit 3 is disposed to produce a propelling force to move the underwater robotic device forward in the water. In this embodiment, the propelling unit 3 includes two front limb mechanisms 31 which are connected with the front housing 15, and two rear limb mechanisms 32 which are connected with the rear housing 16.

With reference to FIG. 3 and FIGS. 6 to 8, each of the front limb mechanisms 31 includes a front limb motor 311 which is mounted in the corresponding front mounting cassette 17 and which has a front motor part (311*a*) (see FIG. 7) that projects forwardly from the corresponding front mounting cassette 17, a front waterproof cover 312 which is in liquid-tight engagement with the corresponding front mounting cassette 17 to cover the front motor part (311*a*) of the front limb motor 311, a front limb rotating axle 313 which is in liquid-tight engagement with the front waterproof cover 312, which is coupled with the front limb motor 311 through an adaptor 314 and which has a front axle part (313*b*) that projects forwardly of the front waterproof cover 312, and a front limb module 315 which is connected with the front limb rotating axle 313 to be rotated therewith. The front limb motor 311 is electronically connected with the control unit 2 through a wire (not shown) which extends through the corresponding front wire passage 156, and is controlled and operated to drive rotation of the front limb rotating axle 313 about a front axis (A1) in the front-rear direction (D1). A cover seal ring (312*a*) is interposed between the front waterproof cover 312 and the front mounting cassette 17 to prevent liquid entrance from the juncture between the front waterproof cover 312 and the front mounting cassette 17. The front limb rotating axle 313 rotatably projects from and is in liquid-tight engagement with the front waterproof cover 312 to retain the front limb motor 311 in a liquid-tight space. In this embodiment, two axle seal rings (313*a*) are interposed between the front limb rotating axle 313 and the front waterproof cover 312, and are spaced apart from each other along the front axis (A1) so as to prevent liquid entrance from the juncture between the front limb rotating axle 313 and the front waterproof cover 312.

Figure 6:
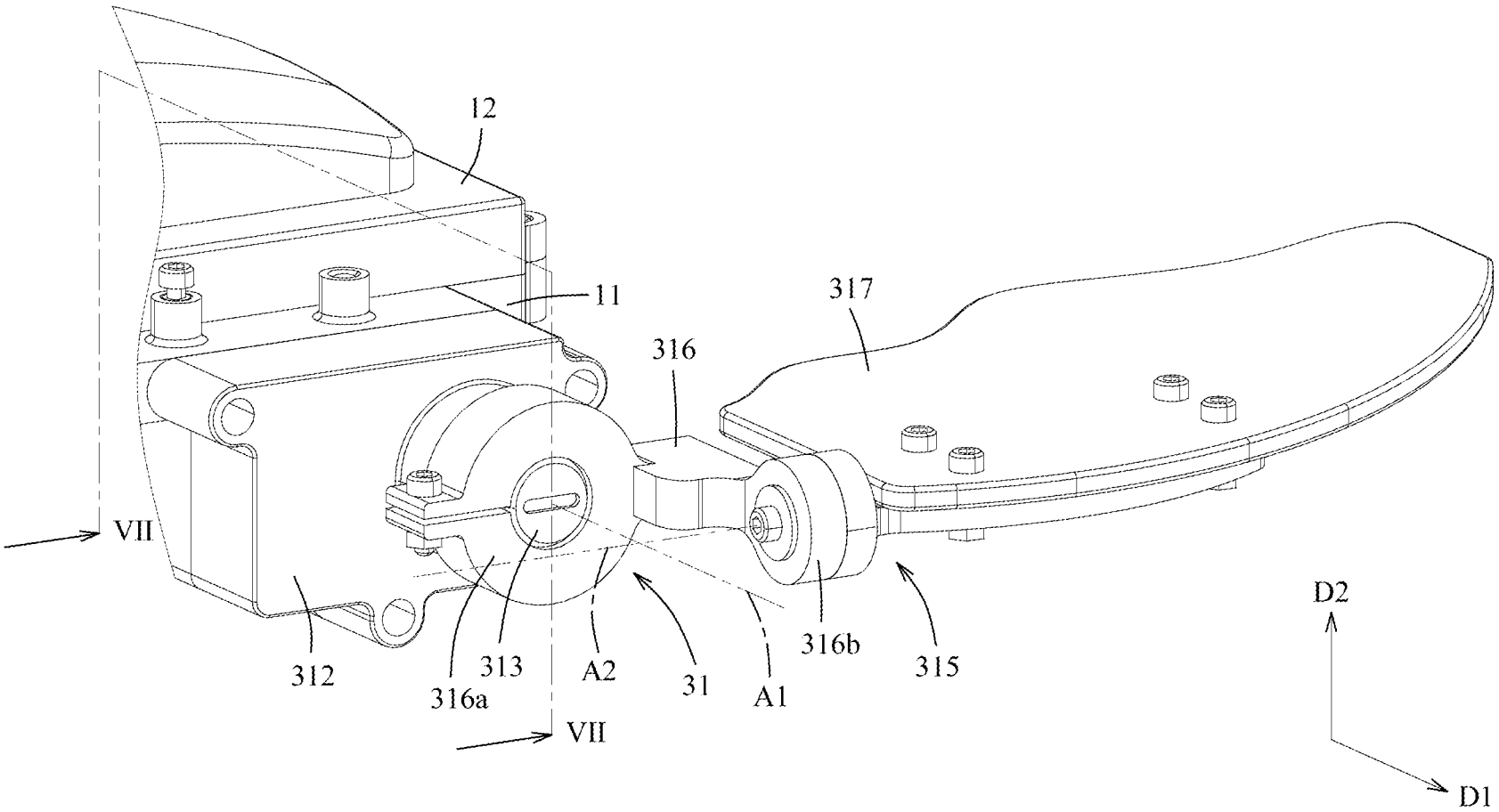
FIG. 6 is a fragmentary perspective view illustrating a front limb mechanism of the embodiment.
Figure 8:
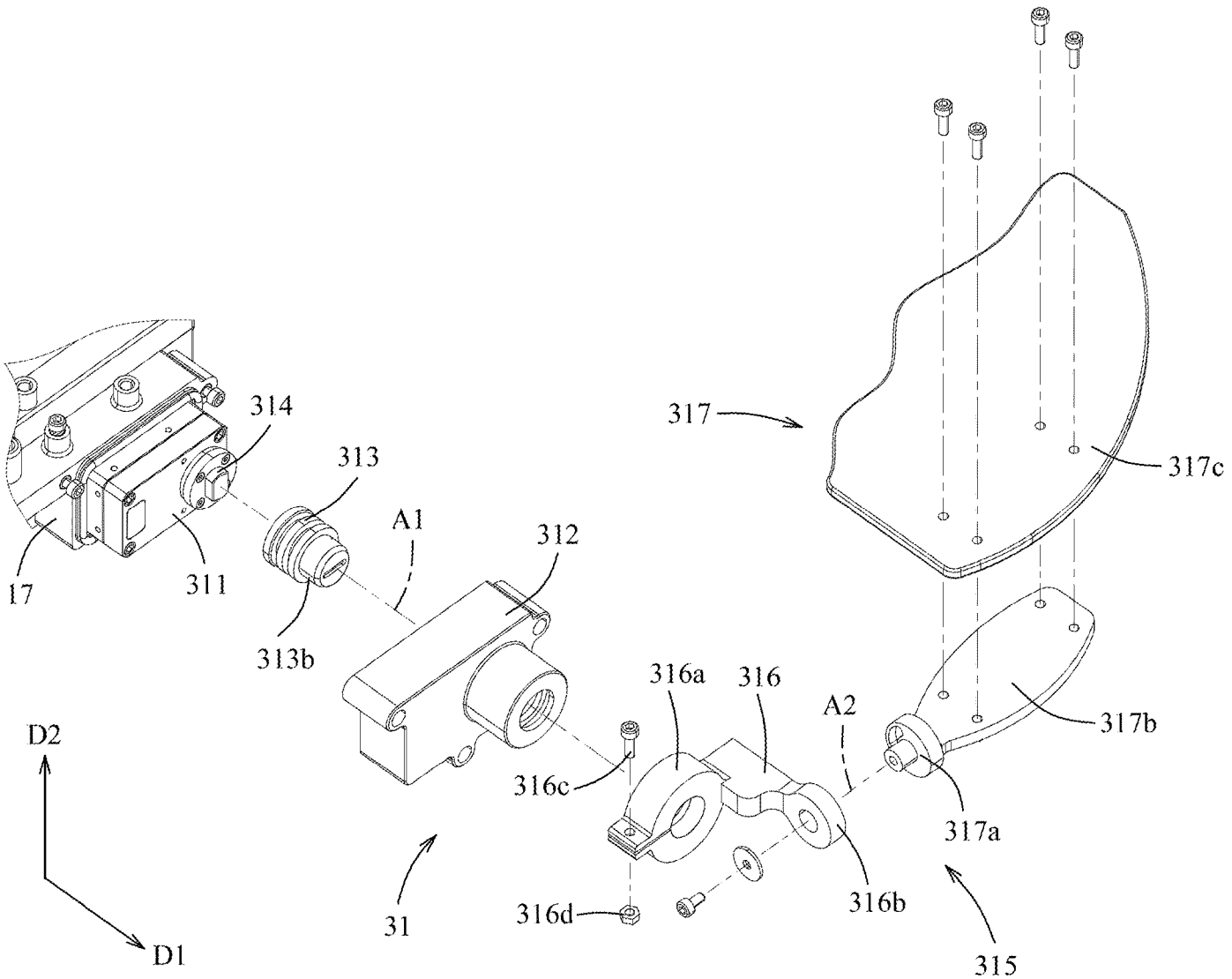
FIG. 8 is a fragmentary exploded perspective view illustrating the front limb mechanism of the embodiment.
Figure 9:
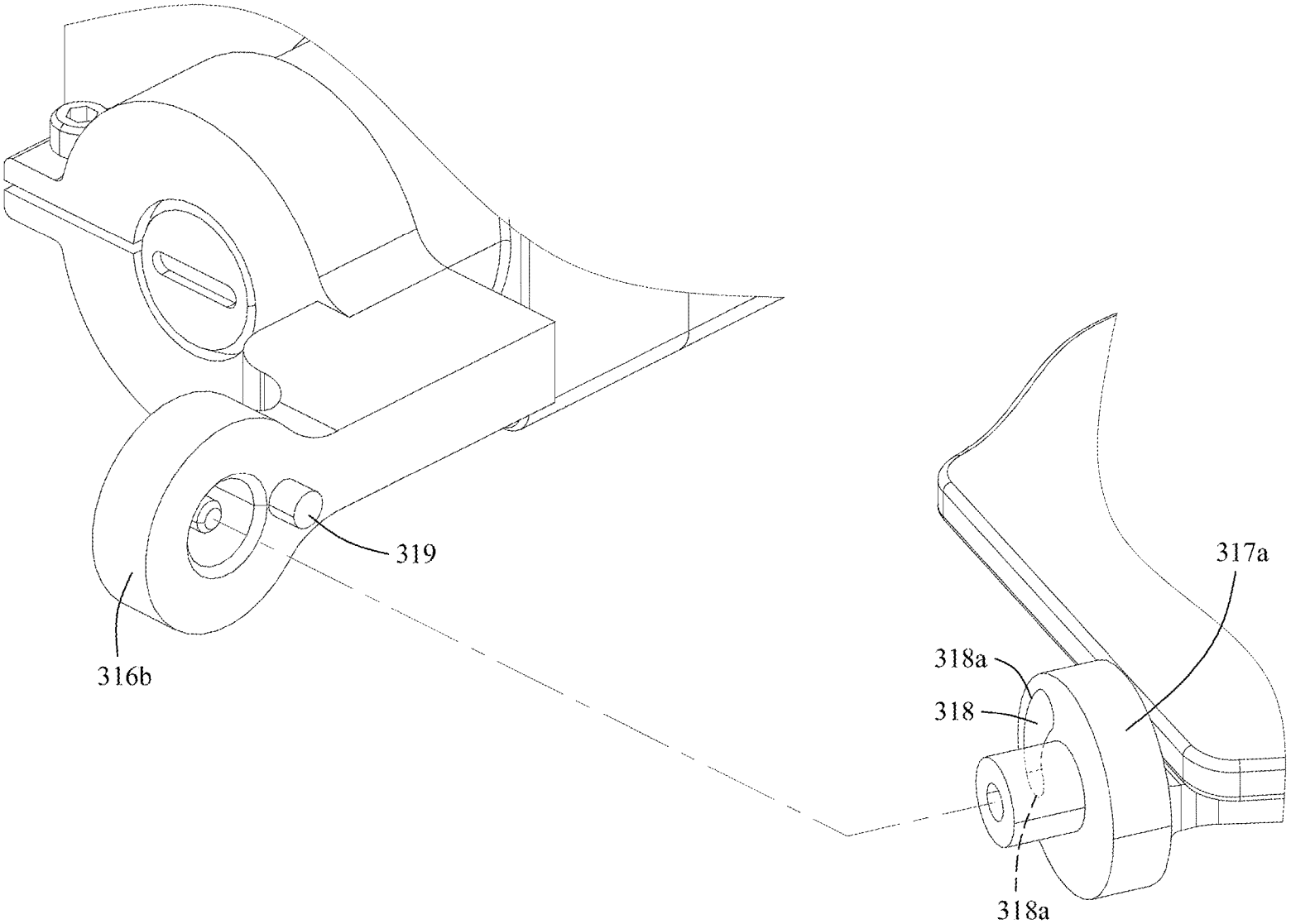
FIG. 9 is a fragmentary exploded perspective view illustrating a portion of the front limb mechanism.

With reference to FIGS. 6, 8 and 9, each of the front limb modules 315 has an L-shaped linkage 316 and a front flipper 317 which is rotatably connected with the L-shaped linkage 316. The L-shaped linkage 316 has a connecting portion (316*a*) which is securely and coaxially connected with the front axle part (313*b*) of the front limb rotating axle 313, and a first pivot portion (316*b*) which extends from and is perpendicular to the connecting portion (316*a*). In this embodiment, the connecting portion (316*a*) has a C-shaped clip section which is clamped on the front axle part (313*b*), and a screw fastener (316*c*) which tightens two ends of the clip section to secure the connecting portion (316*a*) to the front limb rotating axle 313. The front flipper 317 has a second pivot portion (317*a*) which is pivotably connected with the first pivot portion (316*b*) about a rotational axis (A2) that is perpendicular to the front axis (A1) of the front limb rotating axle 313, a support portion (317*b*) which is integrally formed with and extends from the second pivot portion (317*a*) along the rotational axis (A2), and a front flipper portion (317*c*) which is connected and moved with the second pivot portion (317*a*). In this embodiment, the front flipper portion (317*c*) is made of a soft material, and has a connected side portion which is deviated from a center of gravity of the front flipper portion (317*c*) and which is securely connected with the support portion (317*b*). Hence, through the support portion (317*b*), the front flipper portion (317*c*) is moved with the second pivot portion (317*a*). The connected side portion which is connected with the support portion (317*b*) is deviated from the center of gravity of the front flipper portion (317*c*). Specifically, the connecting side portion is located near a front side edge of the flipper portion (317*c*) and adjacent to the second pivot portion (317*a*). In various embodiment, the front flipper portion (317*c*) may be made of a rigid material as requirement. However, the front flipper portion (317*c*) is advantageously made of a soft material for enhancing the dynamic effect and simulation of the underwater robotic device. Moreover, in this embodiment, the front flipper portion (317*c*) is secured to the support portion (317*b*) by means of screw fasteners. Alternatively, the front flipper portion (317*c*) and the support portion (317*b*) may have engaging features which interengage with each other. The front flipper portion (317*c*) may be secured to the support portion (317*b*) by means of bonding primer for bonding two substrates made of different materials. The support portion (317*b*) may be made of metal, plastic, ceramic, glass material, etc. The front flipper portion (317*c*) may be made of elastomeric polymer material, such as silicone, synthetic rubber, etc.

Thus, the connecting portion (316*a*) is rotated with the front limb rotating axle 313 about the front axis (A1) to result in swinging of the front flipper portion (317*c*) in an up-down direction (D2). Also, in the water, during the up-down swing of the front flipper portion (317*c*) by rotation of the front limb rotating axle, a propelling force is generated by the water pressure to the front flipper portion (317*c*), which results in rotation of the second pivot portion (317*a*) about the rotational axis (A2). The connected side portion of the front flipper portion (317*c*) which is connected with the support portion (317*b*) is deviated from the center of gravity of the front flipper portion (317*c*), which facilitates the rotation of the front flipper portion (317*c*) about the rotational axis (A2). As shown in FIG. 9, in this embodiment, the second pivot portion (317*a*) is formed with an arcuate slot 318 which extends to terminate at two slot ends (318*a*), and the first pivot portion (316*b*) is formed with a protrusion 319 which is slidably engaged in the arcuate slot 318 to be slidable along the arcuate slot 318 between the two slot ends (318*a*) so as to restrain the rotation of the second pivot portion (317*a*) relative to the first pivot portion (316*b*). Alternatively, the first pivot portion (316*b*) may be formed with an arcuate slot, and the second pivot portion (317*a*) may be formed with a protrusion. Thus, each front limb mechanism 31 is driven by one motor to rotate with two axes.

With reference to FIGS. 3 and 4, each of the rear limb mechanisms 32 includes a rear limb motor 321 which is mounted in the corresponding rear mounting cassette 18 and which has a lateral motor part (321*a*) that projects laterally from the corresponding rear mounting cassette 18, and a rear waterproof cover 322 which is in liquid-tight engagement with the corresponding rear mounting cassette 18 to cover the lateral motor part (321*a*) of the rear limb motor 321, a rear limb rotating axle 323 which is in liquid-tight engagement with the rear waterproof cover 322, which is coupled with the rear limb motor 321 and which has a lateral axle part (323*a*) that projects laterally of the rear waterproof cover 322, and a rear limb module 324 which is connected with the lateral axle part (323*a*) of the rear limb rotating axle 323 to be rotated therewith. The rear limb motor 321 is electronically connected with the control unit 2 through a wire (not shown) which extends through the corresponding rear wire passage 165, and is controlled and operated to drive rotation of the rear limb rotating axle 323 about a rear axis (A3) in the left-right direction (D3). The rear limb rotating axle 323 rotatably projects from and is in liquid-tight engagement with the rear waterproof cover 322 to retain the rear limb motor 321 in a liquid-tight space. In this embodiment, the rear waterproof cover 322 is in liquid-tight engagement with the corresponding rear mounting cassette 18 in the manner similar to that the front waterproof cover 312 is in liquid-tight engagement with the front mounting cassette 17. Also, the rear limb rotating axle 323 is in liquid-tight engagement with the rear waterproof cover 322 in the manner similar to that of the front limb rotating axle 313 which is in liquid-tight engagement with the front waterproof cover 312. Each rear limb module 324 has a connecting portion (324*a*) which is securely and coaxially connected with the lateral axle part (323*a*) of the rear limb rotating axle 323, and a hind flipper portion (324*b*) which extends rearwardly from the connecting portion (324*a*) and which is rotated with the connecting portion (324*a*) about the rear axis (A3) so as to swing in the up-down direction (D2). In this embodiment, the connecting portion (324*a*) is secured to the rear limb rotating axle 323 in the manner similar to that of the connecting portion (316*a*) of the L-shaped linkage 316 which is secured to the front limb rotating axle 313, a detailed description thereof being dispensed with.

Each of the front limb motors 311 and the rear limb motors 321 is retained in a liquid-tight space, and thus no an expensive waterproof motor is not needed for the underwater robotic device, which saves material cost thereof. Additionally, the front limb motors 311 and the rear limb motors 321 are respectively mounted in the front mounting cassettes 17 and the rear mounting cassettes 18 and are electronically connected with the control unit 2 through wires that extend through the front wire passages 156 and the rear wire passages 165, which renders the construction of the underwater robotic device simplified.

Figure 10:
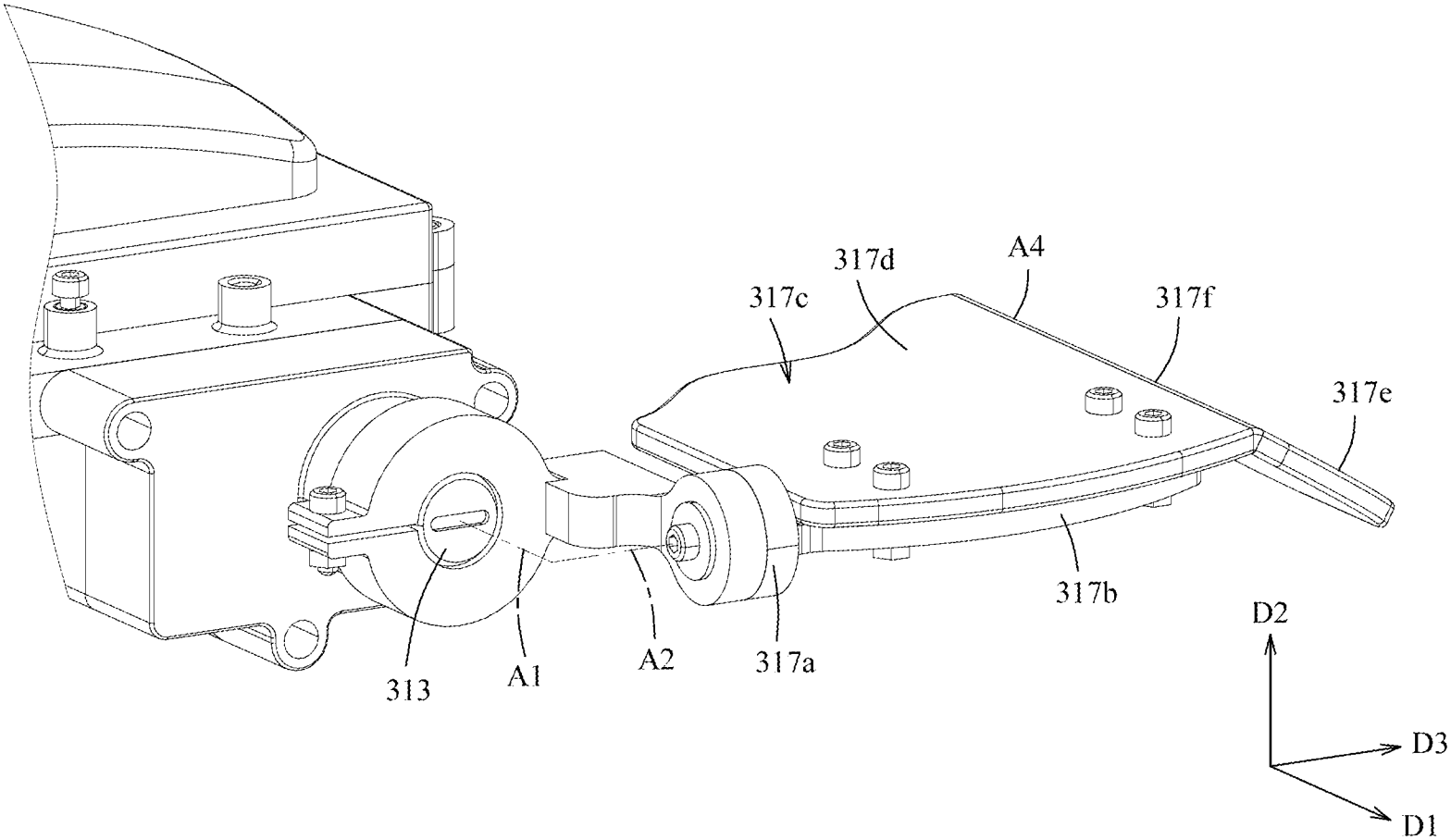
FIG. 10 is a fragmentary perspective view illustrating a front limb mechanism of another embodiment of the underwater robotic device.

With reference to FIG. 10, in another embodiment, the front flipper portion (317*c*) has a flipper section (317*d*) which is supported on the support portion (317*b*) and which extends in the left-right direction (D3) to terminate at a distal rim (317*f*), and a lateral swing section (317*e*) which is pivotably connected with the distal rim (317*f*) of the flipper section (317*d*) to be swingable relative to the flipper section (317*d*) about a swing axis (A4) that is parallel to the front axis (A1). In the water, the lateral swing section (317*e*) is swingable about the swing axis (A4). Thus, similar to the previous embodiment, during the up-down swing of the front flipper portion (317*c*) by rotation of the front limb rotating axle 313 in the up-down direction (D2), a propelling force is generated by the water pressure to the front flipper portion (317*c*), which results in rotation of the second pivot portion (317*a*) about the rotational axis (A2). Further, in this embodiment, with the water pressure to the front flipper portion (317*c*), the lateral swing section (317*e*) is swung about the swing axis (A4) such that the front flipper portion (317*c*) presents a multi-axis dynamic effect.

As illustrated, the underwater robotic device has a simple construction, and the base seat 11 may be formed as a single piece for facilitating easy and quick assembly of component parts. With the center-of-gravity transferring module 22 of a simple structure, the center of gravity of the underwater robotic device can be varied to control ascending and descending of the underwater robotic device in the water. Moreover, each of the front limb motors 311 and the rear limb motors 321 is retained in a liquid-tight space, and thus an expensive waterproof motor is not needed for the underwater robotic device, which saves material cost thereof.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An underwater robotic device movable in water, comprising:

a housing unit including a base seat and an upper cover in liquid-tight engagement with said base seat;

a control unit disposed within said housing unit, and including a circuit module and a center-of-gravity transferring module which is electronically connected with said circuit module, said center-of-gravity transferring module having a weight member which is movable relative to said base seat in a front-rear direction, and a transfer driving mechanism which is coupled with said weight member to drive movement of said weight member in the front-rear direction so as to vary a position of a center of gravity of said underwater robotic device and to control downward and upward moving directions of said underwater robotic device in the water; and a propelling unit connected with said housing unit and electronically connected with said control unit to produce a propelling force to move said underwater robotic device forward in the water, wherein said base seat has a front housing which defines a front compartment therein, and two front mounting cassettes which are connected with and extend from said front housing in the front-rear direction, and wherein said propelling unit includes two front limb mechanisms which are connected with said front housing, said front housing having two front wire passages each of which extends to intercommunicate said front compartment and a respective one of said front mounting cassettes, and each of said front limb mechanisms including a front limb motor which is mounted in the respective one of said front mounting cassettes and which has a front motor part that projects forwardly from said respective front mounting cassette, and a front waterproof cover which is in liquid-tight engagement with said respective front mounting cassette and which covers said front motor part of said front limb motor, a front limb rotating axle which is in liquid-tight engagement with said front waterproof cover, which is coupled with said front limb motor and which has a front axle part that projects forwardly of said front waterproof cover, and a front limb module which is connected with said front limb rotating axle to be rotated therewith, wherein said front limb motor is electronically connected with said control unit through a wire which extends through a respective one of said front wire passages, and is controlled and operated to drive rotation of said front limb rotating axle about a front axis.

2. The underwater robotic device of claim 1, wherein said weight member has a battery holder case and a plurality of batteries which are received in said battery holder case.

3. The underwater robotic device of claim 1, wherein said base seat further has a rear housing which is connected with a rear end of said front housing and which defines a rear compartment therein, said rear compartment being in communication with said front compartment, said weight member being disposed in said front compartment, said transfer driving mechanism having a primary motor which is disposed in said rear compartment, and a crank linkage assembly which interconnects said primary motor and said weight member.

4. The underwater robotic device of claim 3, wherein said propelling unit further includes two rear limb mechanisms which are connected with said rear housing, said base seat further having two rear mounting cassettes which are connected with and extend from said rear housing in a left-right direction, said rear housing having two rear wire passages each of which extends to intercommunicate said rear compartment and a respective one of said rear mounting cassettes, each of said rear limb mechanisms including a rear limb motor which is mounted in the respective one of said rear mounting cassettes and which has a lateral motor part that projects laterally from said respective rear mounting cassette, and a rear waterproof cover which is in liquid-tight engagement with said respective rear mounting cassette and which covers said lateral motor part of said rear limb motor, a rear limb rotating axle which is in liquid-tight engagement with said rear waterproof cover, which is coupled with said rear limb motor and which has a lateral axle part that projects laterally of said rear waterproof cover, and a rear limb module which is connected with said rear limb rotating axle to be rotated therewith, wherein said rear limb motor is electronically connected with said control unit through a wire which extends through a respective one of said rear wire passages, and is controlled and operated to drive rotation of said rear limb rotating axle about a rear axis.

5. The underwater robotic device of claim 4, wherein said front housing has a rectangular front bottom wall, two front lateral walls which extend upwardly and respectively from left and right sides of said front bottom wall, a leading wall which extends upwardly from a front side of said front bottom wall and which interconnects said front lateral walls, and two middle walls which extend upwardly from a rear side of said front bottom wall, which are respectively connected with said front lateral walls and which are spaced apart from each other in the left-right direction, wherein said front bottom wall, said front lateral walls, said leading wall and said middle walls cooperatively border said front compartment, said rear housing having a rectangular rear bottom wall which extends rearwardly from said rear side of said front bottom wall and between said middle walls, two rear lateral walls which extend upwardly and respectively from left and right sides of said rear bottom wall and which are respectively connected with said middle walls, and a trailing wall which extends upwardly from a rear side of said rear bottom wall and which interconnects said rear lateral walls, wherein said rear bottom wall, said rear lateral walls and said trailing wall cooperatively border said rear compartment, said front mounting cassettes being integrally formed with said leading wall and being spaced apart from each other in the left-right direction, said front wire passages extending through said leading wall, said rear mounting cassettes being integrally and respectively formed with said rear lateral walls, said rear wire passages respectively extending through said rear lateral walls.

6. The underwater robotic device of claim 5, wherein said rear limb module of each of said rear limb mechanisms has a connecting portion which is securely and coaxially connected with said lateral axle part of said rear limb rotating axle, and a hind flipper portion which extends rearwardly from said connecting portion and which is rotated with said connecting portion about the rear axis so as to swing in an up-down direction.

7. The underwater robotic device of claim 5, wherein each of said front limb modules has an L-shaped linkage and a front flipper which is rotatably connected with said L-shaped linkage, said L-shaped linkage having a connecting portion which is securely and coaxially connected with said front axle part of said front limb rotating axle, and a first pivot portion which extends from and is perpendicular to said connecting portion, said front flipper having a second pivot portion which is pivotably connected with said first pivot portion about a rotational axis that is perpendicular to the front axis of said front limb rotating axle, and a front flipper portion which is connected and moved with said second pivot portion such that said connecting portion is rotated with said front limb rotating axle about the front axis to result in swinging of said front flipper portion in an up-down direction, and the swinging of said front flipper portion in the up-down direction in the water results in rotation of said second pivot portion about the rotational axis.

8. The underwater robotic device of claim 7, wherein one of said first pivot portion and said second pivot portion is formed with an arcuate slot which extends to terminate at two slot ends, and the other one of said first pivot portion and said second pivot portion is formed with a protrusion which is slidably engaged in said arcuate slot to be slidable along said arcuate slot between said two slot ends so as to restrain the rotation of said second pivot portion relative to said first pivot portion.

9. The underwater robotic device of claim 8, wherein said front flipper of each of said front limb modules further has a support portion which is integrally formed with and extends from said second pivot portion along the rotational axis, said front flipper portion being made of a soft material and having a connected side portion which is deviated from a center of gravity of said front flipper portion and which is securely connected with said support portion.

10. The underwater robotic device of claim 9, wherein said front flipper portion has a flipper section which is supported on said support portion and which extends in the left-right direction to terminate at a distal rim, and a lateral swing section which is pivotably connected with said distal rim of said flipper section to be swingable relative to said flipper section about a swing axis that is parallel to the front axis.

* * * * *